US009269286B2

(12) United States Patent
Marten

(10) Patent No.: US 9,269,286 B2
(45) Date of Patent: Feb. 23, 2016

(54) AUTOMATED OVERSCAN ADJUSTMENT

(75) Inventor: Neil Marten, Denver, CO (US)

(73) Assignee: Echostar Technologies, LLC, Englewood, CO (US)

( * ) Notice: Subject to any disclaimer, the term of this patent is extended or adjusted under 35 U.S.C. 154(b) by 122 days.

(21) Appl. No.: 13/463,282

(22) Filed: May 3, 2012

(65) Prior Publication Data

US 2013/0293574 A1 Nov. 7, 2013

(51) Int. Cl.
*G09G 5/00* (2006.01)
*G09G 3/00* (2006.01)

(52) U.S. Cl.
CPC ..... *G09G 3/006* (2013.01); *G09G 2340/0407* (2013.01); *G09G 2354/00* (2013.01)

(58) Field of Classification Search
None
See application file for complete search history.

(56) References Cited

U.S. PATENT DOCUMENTS

2013/0058593 A1* 3/2013 Kanalakis et al. ..... 382/286

* cited by examiner

*Primary Examiner* — Mohammad H Akhavannik
(74) *Attorney, Agent, or Firm* — Kilpatrick Townsend & Stockton LLP

(57) ABSTRACT

Techniques are disclosed for automatically calibrating content shown on an electronic display. According to certain embodiments, a picture of the display is taken while a calibration image is shown on the display. The picture is then analyzed to determine whether any adjustments need to be made. The analysis can, for example, include a comparison between the picture of the calibration image and a stored calibration image. If it is determined an adjustment needs to be made to correct how content is shown on the display, an adjustment is made accordingly.

17 Claims, 8 Drawing Sheets

AUTOMATED OVERSCAN ADJUSTMENT

BACKGROUND

Televisions, computer monitors, tablet computers, notebooks, and other devices having electronic displays can display content from a variety of sources, including other connected devices. Televisions, for example, can be connected with a set-top box that can provide television tuning, video recording, and other functionality to the television. These connected devices may allow for menus, icons, or other content to be shown on the displays. But because different electronic displays have different properties, it is not always certain that the content is properly shown on each of the electronic displays. Consequently, some items may not be shown on the electronic display at all. The connected devices or the displays themselves may have the functionality for adjusting the content, but users are typically unaware of this functionality.

SUMMARY

Techniques are disclosed for automatically calibrating content shown on an electronic display. According to certain embodiments, a picture of the display is taken while a calibration image is shown on the display. The picture is then analyzed to determine whether any adjustments need to be made. The analysis can, for example, include a comparison between the picture of the calibration image and a stored calibration image. If it is determined an adjustment needs to be made to correct how content is shown on the display, an adjustment is made accordingly.

According to one embodiment, a method for automatically calibrating content shown on an electronic display can include causing a calibration image to be shown on the electronic display, where the displayed calibration image has one or more calibration elements. The method also can include receiving, via an input interface, a first captured image of the electronic display. The first captured image can include a representation of the displayed calibration image. The method further can include comparing the representation of the displayed calibration image with a stored calibration image, determining that a position of at least one calibration element of the displayed calibration image is not located at a certain position of the electronic display, and calculating, using a processor, an amount of adjustment based on the position of the at least one calibration element. Finally, the method can include adjusting the content shown on the electronic display based, at least in part, on the amount of adjustment.

The method for automatically calibrating content shown on an electronic display can include one or more of the following features. Receiving the first captured image can comprise receiving the first captured image from a portable electronic device via a wireless connection. The portable electronic device can be a mobile phone with image-capturing functionality. Adjusting the content shown on the electronic display can comprise adjusting a video signal provided to the electronic display. The method can include receiving a second captured image of the electronic display, and determining whether to make an additional adjustment to the content shown on the electronic display. The method can include, after a certain number of adjustments, enabling a user to provide input to adjust the content shown on the electronic display. The calibration image can be an image overlay on the content shown on the electronic display.

According to another embodiment, a system for automatically calibrating content shown on an electronic display can include an output interface configured to be communicatively coupled with the electronic display, a communication interface configured to receive one or more captured images, and a processing unit coupled with the communication interface and the output interface. The system also can include a memory communicatively coupled with and readable by the processing unit and having stored therein processor-readable instructions which, when executed by the processing unit, cause the processing unit to cause, via the output interface, a calibration image to be shown on the electronic display. The displayed calibration image can have one or more calibration elements. The instructions can further cause the processing unit to receive, via the communication interface, a first captured image of the electronic display, where the first captured image including a representation of the displayed calibration image. The instructions additionally can cause the processing unit to compare the representation of the displayed calibration image with a stored calibration image, determine that a position of at least one calibration element of the displayed calibration image is not located at a certain position of the electronic display, and calculate an amount of adjustment based on the position of the at least one calibration element. Finally, the instructions can cause the processing unit to adjust, via the output interface, the content shown on the electronic display based, at least in part, on the amount of adjustment.

The system for automatically calibrating content shown on an electronic display can include one or more of the following features. The communication interface can be configured to receive the one or more captured images wirelessly. The system can comprise a set-top box configured to be connected to a television via the output interface. The instructions can be configured to cause the processing unit to adjust the content shown on the electronic display by adjusting a video signal provided to the electronic display via the output interface. The instructions can be configured to cause the processing unit to receive, via the communication interface, a second captured image of the electronic display, and determine whether to make an additional adjustment to the content shown on the electronic display. The instructions can be configured to cause the processing unit to, after a certain number of adjustments, receive input to adjust the content shown on the electronic display via the user interface. The instructions can be configured to cause the processing unit to show the calibration image is an image overlay on the content shown on the electronic display.

According to yet another embodiment, a method for automatically calibrating content shown on an electronic display is provided. The method includes sending, via a wireless interface, instructions to cause an electronic display to output a calibration image. The displayed calibration image has one or more calibration elements. The method also includes capturing, with a camera, a first captured image of the electronic display. The first captured image includes a representation of the displayed calibration image. The method further includes comparing the representation of the displayed calibration image with a stored calibration image, determining that a position of at least one calibration element of the displayed calibration image is not located at a certain position of the electronic display, and calculating, using a processor, an amount of adjustment based on the position of the at least one calibration element. Finally, the method includes sending, via the wireless interface, instructions to cause the content shown on the electronic display to be adjusted based, at least in part, on the calculated amount of adjustment.

The method for automatically calibrating content shown on an electronic display can include one or more of the following features. The camera can be integrated with a mobile phone. Sending the instructions to cause the electronic display to output a calibration image can include sending instructions to a set-top box communicatively coupled with the electronic display. The method can include capturing, with the camera, a second captured image of the electronic display, and determining whether to make an additional adjustment to the content shown on the electronic display. A user interface can be provided to enable a user to provide input to adjust the content shown on the electronic display. Providing a user interface can include showing the user interface on a display of a portable electronic device.

Numerous benefits are achieved over conventional techniques. For example, the content shown on the electronic display can be automatically calibrated with minimal effort or interaction from a user. Additionally, different electronic devices may be used to capture the image, which can provide added functionality and convenience to the user. These and other embodiments, along with many of its advantages and features, are described in more detail in conjunction with the text below and attached figures.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Embodiments are directed to automatically calibrating content shown on an electronic display. Such functionality can help ensure that the content is shown properly, which can enabling a user to see and take advantage of any content that may not otherwise be shown on the display. This automated process can be performed quickly and easily, resulting in a more positive user experience.

Although embodiments detailed herein below are directed toward calibrating content related to television programming and menus, the principles easily can be extended to other types of content and devices, such as video games, media playback, and the like. In addition, the terms "television" or "television service" can include traditional television programming, such as linear television program, as well as other types of audio, video and/or audio/video content, such as on-demand video content, streaming video content and the like delivered via any type of content delivery systems, such as a cable, satellite, cellular/wireless, Internet/IP and/or any other content delivery technology or system currently known or hereinafter developed. Furthermore, embodiments herein describe set-top boxes and/or other devices being connected with a television or other device having an electronic display. However, the automated calibration process can also be incorporated into the device having the electronic display, such as a television with an integrated cable, satellite or IPTV receiver. However, the techniques discussed herein can be extended to any of a variety of other electronic display devices, such as, for example, computers, tablets, hand-held mobile devices, cell phones, e-readers, personal media players, and the like. A person of ordinary skill in the art will recognize various alterations, additions, omissions, and substitutions.

Figure 1:
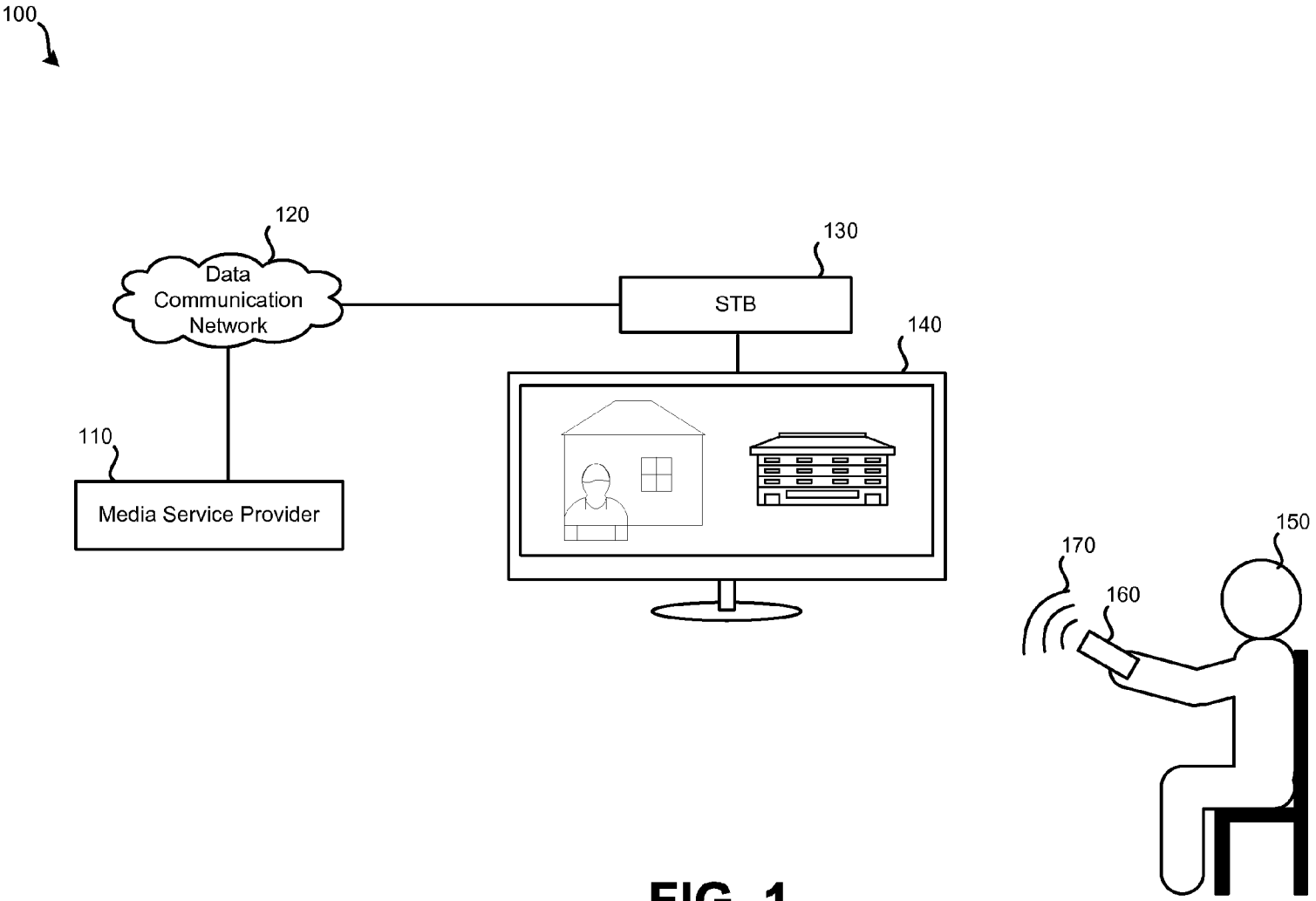
FIG. 1 is a simplified illustration of a media service system, according to an embodiment.

FIG. 1 is a simplified illustration of an embodiment of a media service system 100. The media service system 100 may include a media service provider 110, data communication network 120, set-top box (STB) 130, and television 140. The television 140 can be controlled by a user 150 using a portable electronic device 160 that can send wireless signals 170 to communicate with the STB 130 and/or television 140. Alternate embodiments of the media service system 100 may include fewer or greater numbers of components. While only one STB 130 and television 140 are illustrated, it should be understood that multiple (tens, thousands, millions, etc.) instances of user equipment may be connected with the data communication network 120.

The media service provider 110 can provide media, in various forms, communicated via the data communication network 120. For example, media service provider 110 may be a television service provider providing one or more television channels with audio and/or video feeds that can be provided in multiple formats (e.g., standard definition and high definition). Additionally or alternatively, the media service provider can comprise a server providing streaming and/or downloadable media content, available on demand and/or in accordance with a programming schedule.

The data communication network 120 is the infrastructure by which the media is distributed for viewing. It can comprise any combination of a variety of data communication systems, for example, cable, satellite, wireless/cellular, or Internet systems, or the like, utilizing various transport technologies and/or protocols, such as radio frequency (RF), optical, satellite, coaxial cable, Ethernet, cellular, twisted pair, other wired and wireless technologies, and the like. The network type can comprise packet- and/or circuit-type switching, and can include one or more open, closed, public, and/or private networks, including the Internet, depending on desired functionality, cost concerns, and other factors.

The STB 130 also can vary in form and function. The STB 130 may be used to decode media video and/or audio of communicated via the data communication network 120 for display on the television 140. (In other embodiments, an electronic display other than a television may be used.) As discussed above, in some embodiments the STB 130 may be integrated into a television, computer, or other end-user display or presentation device. In other embodiments, the STB 130 may be a separate device connected with the data communication network 120 through a communication interface, and connected with the television 140 through an output interface. The STB 130 can be configured to cause the television 140 to display a menu, such as an electronic programming guide (EPG), that provides the user 150 different options and functionality for viewing media content.

Figure 2:
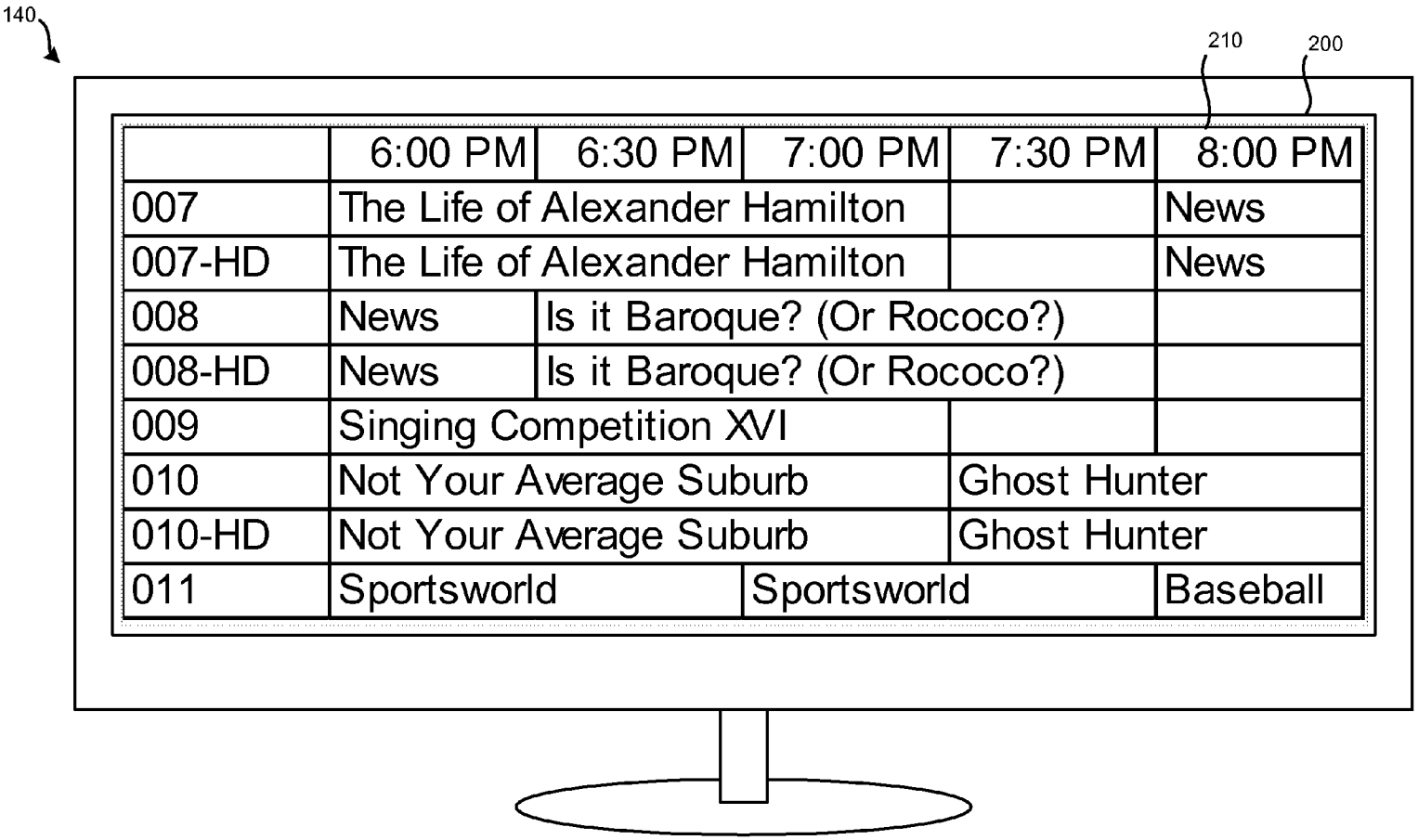
FIG. 2 is an illustration of an embodiment of an electronic programming guide (EPG) shown on the electronic display of a television.

FIG. 2 is an illustration of an embodiment of an EPG 210 shown on the electronic display 200 of a television 140, which may be generated and/or caused to be shown on the electronic display 200 by an STB 130. In this embodiment, the EPG 210 displays a grid that shows the programming of multiple television channels over a period of time, although techniques provided herein can apply to any of a variety of menus and/or other content of the STB 130 shown on the electronic display 200. The EPG 210 may be updated based on locally-gathered information by an STB 130 and/or by information obtained from a remote system, such as media service provider 110 of FIG. 1.

Figure 3:
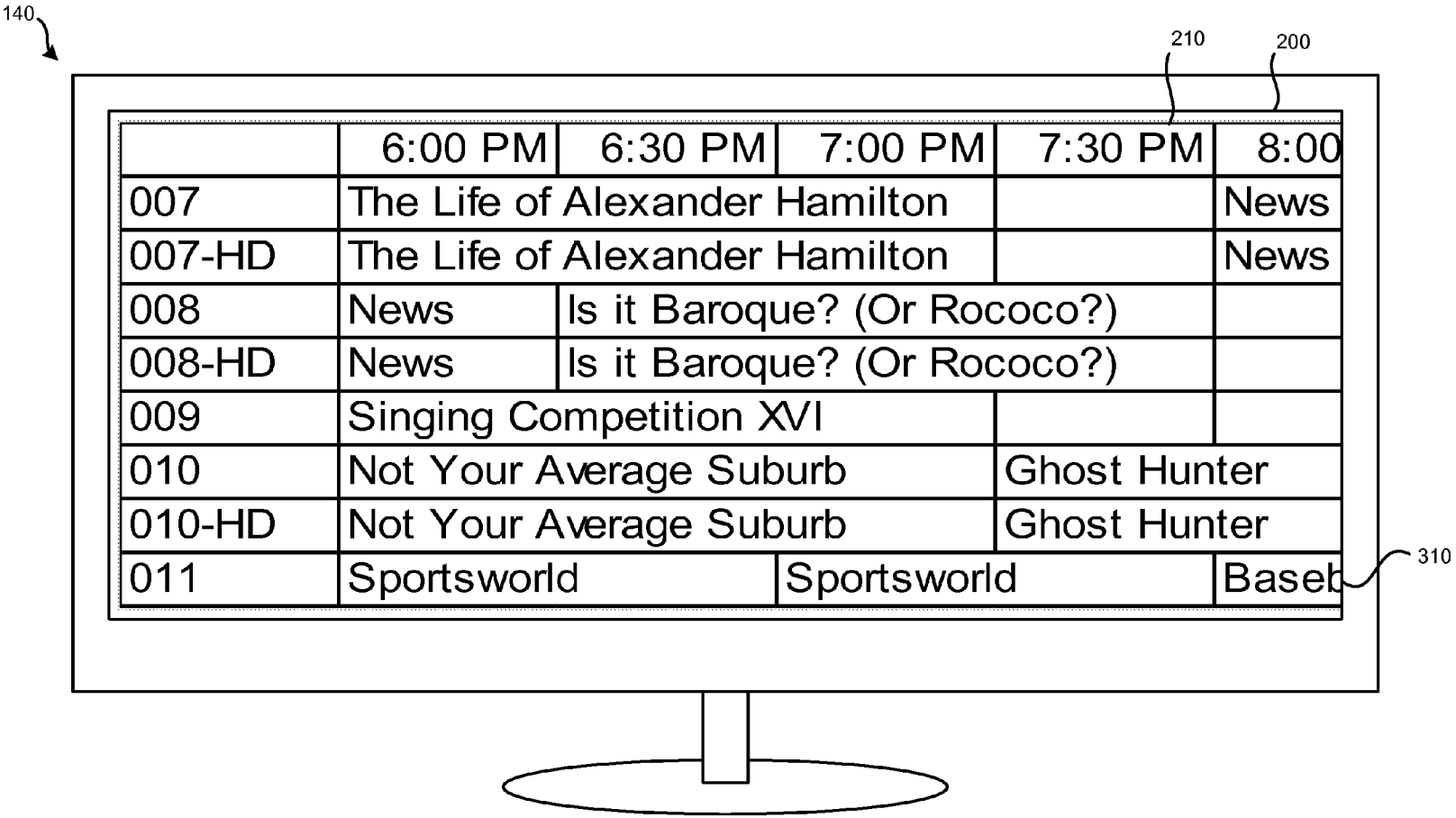
FIG. 3 is an illustration of an EPG extending beyond the right edge of a viewable portion of an electronic display.

FIG. 2 shows the entirety of the EPG 210 as being shown on the electronic display 200. Because different televisions have different types of displays, however, this may not always be the case. The EPG 210 (or other content) may therefore suffer from overscan issues that may cause a portion of the EPG 210 to extend beyond the dimensions of the electronic display 200. FIG. 3, for example illustrates how the EPG 210 may extend beyond the right edge 310 of the electronic display 200, which causes some of the content of the EPG 210 not to be shown on the electronic display 200. It can be problematic when the contents extend beyond one or more of the display's edges, especially with regard to menus, because functions, such as buttons or other selection items, may be hidden from a user's view. Conventional methods of dealing with this problem typically involve working around the problem rather than solving it.

Figure 4:
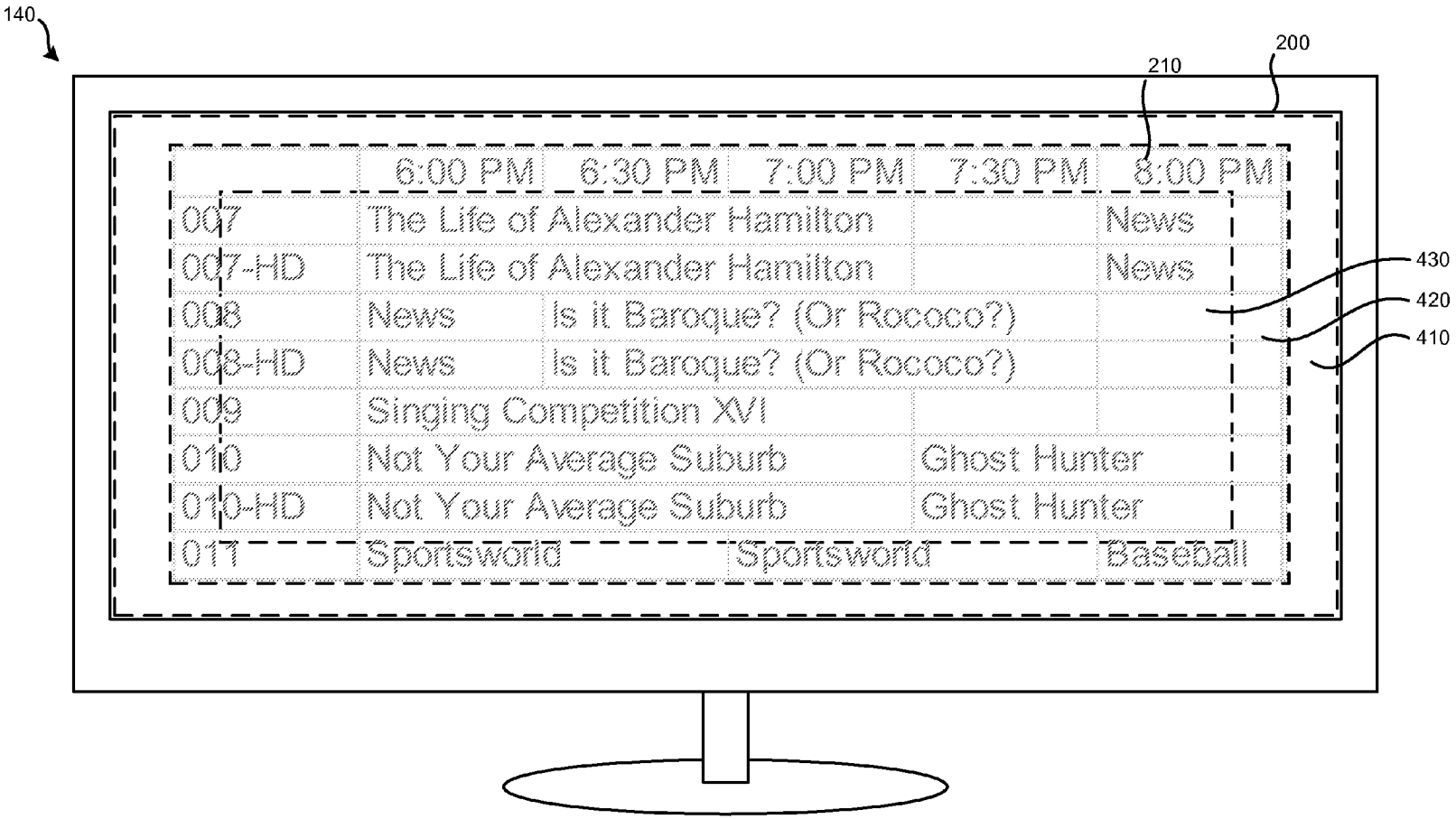
FIG. 4 is an illustration of how content of an EPG may be split up into different areas or zones to help mitigate the effects issues resulting in incorrect or undesired placement of content on an electronic display.

FIG. 4 is an illustration of how content of an EPG 210 or other menu may be split up into different areas or zones 410, 420, 430 in an attempt to mitigate the effects of overscan and/or other issues resulting in incorrect or undesired placement of content on the electronic display 200. The content shown on the EPG 210 can vary based on these zones. A first zone 430 nearest the center of the menu can be considered an area in which interactive elements, such as menu buttons, may be located to help ensure they are viewable by a user. A second zone 420 located farther from the center can be considered an area in which titles or text can be shown with an allowable degree of certainty that it will be visible to a viewer. Because titles or text may not be considered as important as interactive elements, it may not matter that items in the second zone 420 may be at more of a risk of not being shown on the electronic display 200 than items in the first zone 430. Finally, a third zone 410 can be located even farther from the center of the menu, which may be considered as an area in which little or no text or graphics is displayed due to the likelihood that items in the third zone 410 may not be shown on at least some televisions (or other display types).

This tiered structure, or similar structures and/or techniques, may be used by manufacturers of the STB 130 and/or designers of the EPG 210 to help insure that certain types of information is shown to all users. Problematically, however, this results in a portion of the electronic display 200 of at least a few types of televisions being underutilized or not used at all. While many STBs 130 allow for the EPG 210 to be adjusted, this is typically a manual process that requires the user to configure a proper size and/or location of the EPG 210 using buttons shown on the display or physical buttons on the STB 130 itself. Few users typically know or utilize this manual adjustment feature.

To allow designers of the EPG 210 to take advantage of a larger portion of the display without the concern of whether portions of an EPG 210 will not be viewable on the display, the techniques described herein provide for automatically calibrating content shown on an electronic display, such as the EPG 210, which can be performed quickly and easily, resulting in a more positive user experience.

The contemplated automatic calibration additionally can require little or no extra equipment. Referring to the media service system 100 of FIG. 1, for example, a portable electronic device 160 equipped with a camera can be used to capture an image of how the EPG 210 is shown on the electronic display of the television 140. The portable electronic device 160 may wirelessly communicate the image to the STB 130 to adjust the EPG 210 accordingly.

In some embodiments, for example, the portable electronic device 160 can comprise a tablet, hand-held mobile devices, mobile phone (e.g., smart phone, feature phone, or other cell phone type), e-reader, personal media device, remote control, and/or similar device with a camera. The portable electronic device 160 and/or EPG 210 may prompt a user to capture an image of the television 140, using the camera of the portable electronic device 160. This image can then be analyzed by the STB 130, portable electronic device 160, or other component in the media service system 100 to determine whether it is being displayed properly and to make adjustments to the EPG 210 accordingly.

Figure 5:
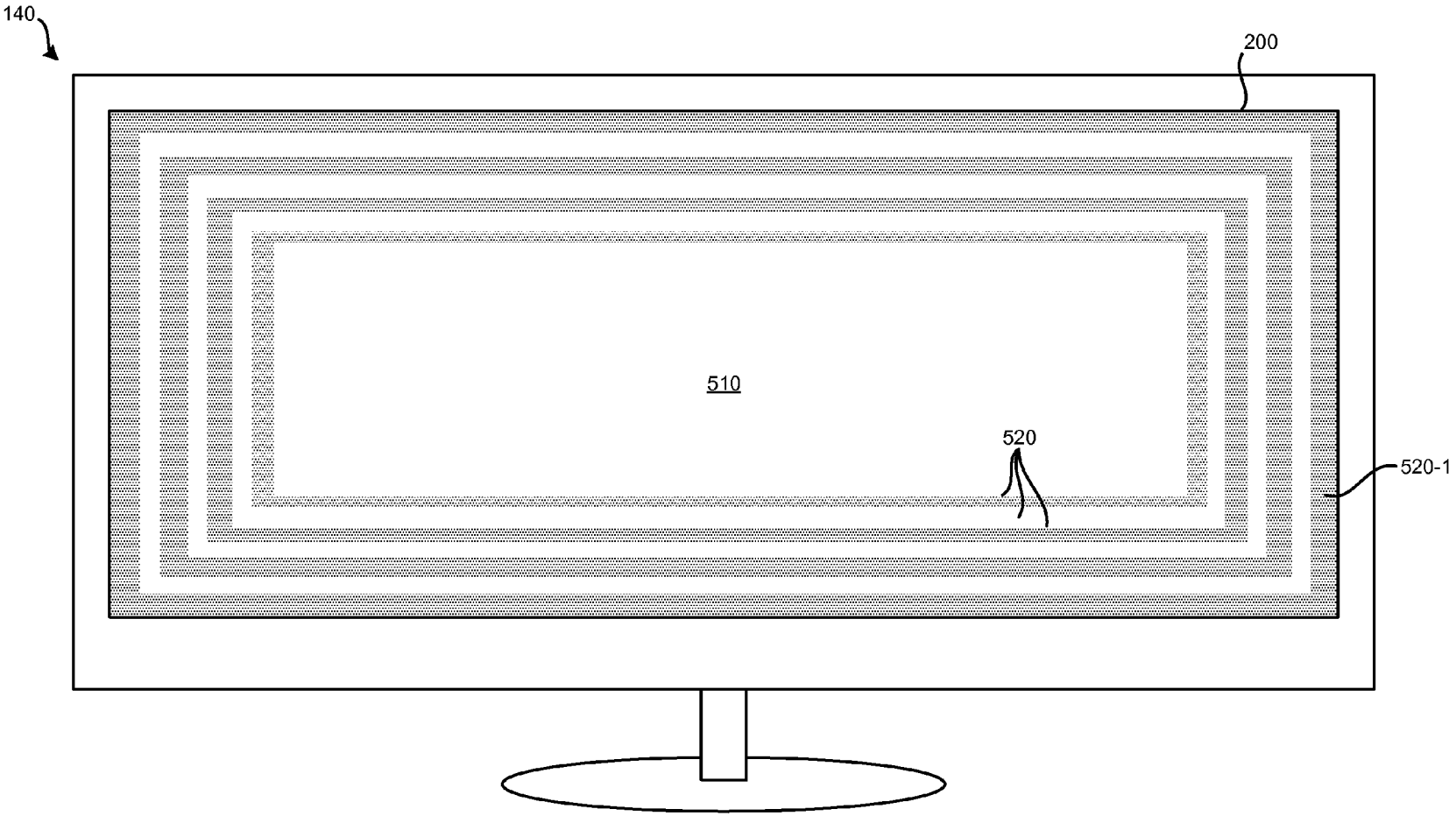
FIG. 5 is a simplified illustration of a calibration image shown on an electronic display, according to one embodiment.

To aid in this process, the STB 130 can cause a calibration image to be shown on the electronic display of the television. FIG. 5 is a simplified illustration of such a calibration image 510 shown by a television 140. The calibration image can include one or more calibration elements 520, which facilitate the determination of how the calibration image is shown on the electronic display 200. Furthermore, the calibration image 510 can be overlaid on content (e.g., a menu) shown by on the electronic display 200, or may be shown by itself with no other images or content.

The content of the calibration image 510 can vary depending on various factors, such as video resolution (e.g., standard or high-definition), estimated native resolution of the display, and more. It may also vary depending on if the process is trying to remedy a particular type of overscan (e.g., a different image may be used to remedy content extending beyond the right edge of the display than an image used to remedy content extending beyond the bottom edge of the display). The calibration elements 520-1 can include one or more of a variety of types of shapes, icons, or other items to help determine how and where content is being shown on the display. Such elements can include gridlines and/or or concentric rectangles with different colors and/or shades. If, for example, an outermost calibration element 520-1 is red, and an analysis of the captured image determines that one or more portions of the red outermost calibration element 520-1 is missing, the content shown on the electronic display 200 can be adjusted accordingly. The size and/or thickness of the calibration elements 520 may vary and may impact the granularity of the detection of any needed adjustment.

Figure 6A:
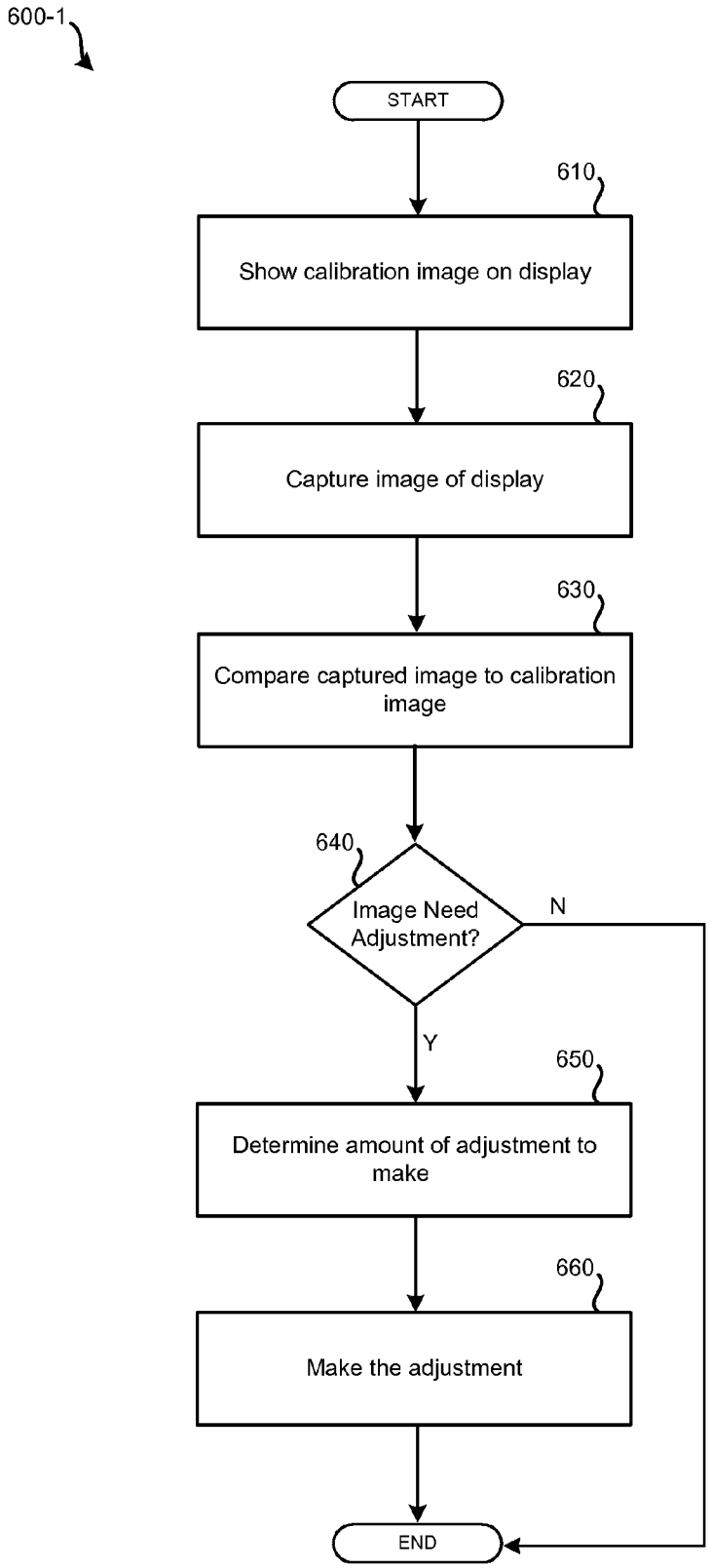
FIGS. 6A-6B are simplified flow diagrams of first and second embodiments of a method for automatically calibrating content shown on an electronic display.

FIG. 6A is a simplified flow diagram of a first embodiment of a method 600-1 for automatically calibrating content shown on an electronic display. The method 600-1 may be performed using the system of FIG. 1 and/or the calibration image 510 of FIG. 5. Moreover, certain blocks of the method 600-1 may be performed by one or more components of the media service system 100 of FIG. 1, such as the portable electronic device 160 and/or STB 130. Means for performing each step of method 600-1 can include hardware and/or software components, such as those detailed herein below with regard to FIG. 7.

At block 610, a calibration image is shown on the electronic display. According to some embodiments, an STB 130 communicatively coupled with a television 140 via an output interface of the STB 130 may provide the calibration image in the same manner it provides other content (e.g., a menu) to the television, such as via a digital and/or analog video signal or stream. In some embodiments, portable electronic device 160, can wirelessly send instructions to the STM 130 and/or electronic display to cause the calibration image to be shown.

An image of the electronic display is captured at block 620. The image can be taken by a camera-equipped portable electronic device 160, as discussed above, and/or provided by a dedicated video or still image camera. In some embodiments, the image (or part of it) then can be communicated to an STB 130 for analysis. In other embodiments, some or all of the analysis may be conducted by the portable electronic device 160 (e.g., a smart phone running an application configured to capture and analyze the displayed calibration image) and/or one or more remote (e.g., "cloud-based") systems. Such systems can include, for example, one or more servers of the media service provider 110 communicatively connected with the portable electronic device 160 and/or STB 130 via the data communication network 120. The STB 130, television 140, and/or portable electronic device 160 may indicate to the user when to point the camera at the display, and whether a successful image (e.g., one that can be analyzed for automatic calibration of the display) was captured, or whether another image is required. The portable electronic device 160 can communicate the captured image and/or other information to the STB 130 using a communication subsystem, such as that described with regard to FIG. 7 below, which can use any of a variety of wired (twisted pair, coaxial, etc.) and wireless (radio frequency (RF), optical (e.g., infrared), etc.) technologies.

At block 630, the displayed calibration image (as provided in the captured image) is compared to a stored calibration image. This comparison can be conducted by the STB 130, the portable electronic device 160, or another device having a processing unit or otherwise capable of conducting the comparison. Because the comparing of block 630 can be done automatically, the comparison of the captured image to the calibration image may not comprise a side-by-side comparison, but instead may simply involve determining whether one or more calibration elements identified in the displayed calibration image is at a certain position of the electronic display (i.e., a known position of the stored calibration image).

At block 640, it is determined whether the displayed image needs an adjustment. In particular, if it is determined, from the comparison of the displayed calibration image with the stored calibration image), that a position of at least one calibration element of the displayed calibration image is not located at a certain position of the electronic display, then an amount of adjustment to make is determined at block 650. Otherwise, if no adjustment is needed, then the process ends. Different embodiments may implement different thresholds for adjustment, such that, if the position of at least one calibration element of the displayed calibration image is within a threshold distance from where it should be (as provided by the stored calibration image), then no adjustment is made.

The determination of the amount of adjustment to make, at block 650, can include a variety of factors. These factors can include, for example, a determination of how far from its desired location a displayed calibration element is located on the electronic display, whether one or more calibration elements are missing, the resolution of the display, the resolution of the captured image, the size of the calibration elements, and more. In embodiments where the determination is made with a portable electronic device 160, the portable electronic device 160 can wirelessly send instructions to the STB 130 and/or electronic display to cause the content to be adjusted appropriately.

At block 660, the content shown on the electronic display is adjusted based, at least in part, on the amount of adjustment determined in block 650. The adjustment may include an adjustment to the size, location, and/or shape of the content. Furthermore, depending on the accuracy of the determination of block 660, the adjustment may be made as a percentage (e.g., reduce the horizontal and vertical dimensions of the content by 5%) or as an amount of pixels (e.g., reduce the horizontal dimension of the content by 89 pixels, and the vertical dimension by 50 pixels).

Figure 6B:
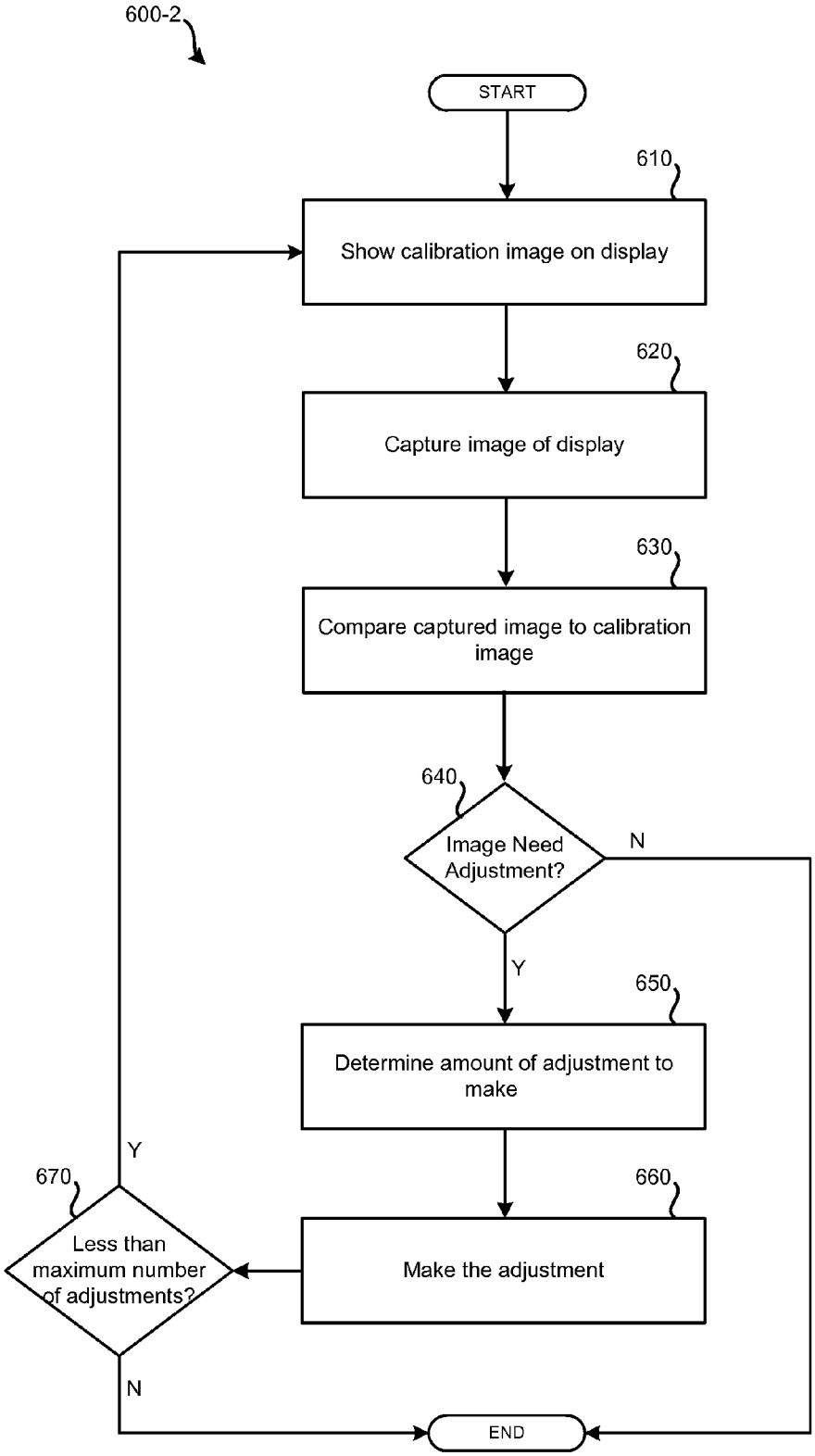

FIG. 6B is a simplified flow diagram of a second embodiment of a method 600-2 for automatically calibrating content shown on an electronic display. The method 600-2 of FIG. 6B includes blocks similar to the method 600-1 of FIG. 6A. Here, however, the method 600-2 of FIG. 6B illustrates an iterative process in which, at block 670, if less than a maximum number of adjustments have been made, then the calibration process can be repeated until either no more adjustments are needed (block 640) or a maximum number of adjustments are made (block 670). For example, blocks 610-660 may be performed 3 times in an attempt to automatically calibrate the contents shown on a display. If further adjustment is needed after the 3 attempts, a manual process can be initiated in which a user can use menu buttons on the display, buttons on an STB, or other input mechanisms to adjust the contents of the display manually. In some embodiments, the manual process can be conducted via the portable electronic device 160, in which case the portable electronic device 160 can provide a user interface (e.g., display a graphical user interface) with buttons and/or other input features to enable a user to provide input to make manual adjustments (i.e., adjustments based on user input) to the display.

It should be appreciated that the specific steps illustrated in FIGS. 6A-6B provide a examples of methods for automatically calibrating content shown on an electronic display. Alternative embodiments may include alterations to the embodiments shown. For example, alternative embodiments may include an application running on a smart phone and/or other mobile device that permits the smart phone (or other mobile device) to capture an image of the display and perform at least some analysis of the image, including, in some embodiments, determining the amount of adjustment. Other embodiment may include inserting the task of block 670 (determining whether a maximum number of adjustments has been met) elsewhere in the method 600-2. Furthermore, additional features may be added or removed depending on the particular applications. One of ordinary skill in the art would recognize many variations, modifications, and alternatives.

Figure 7:
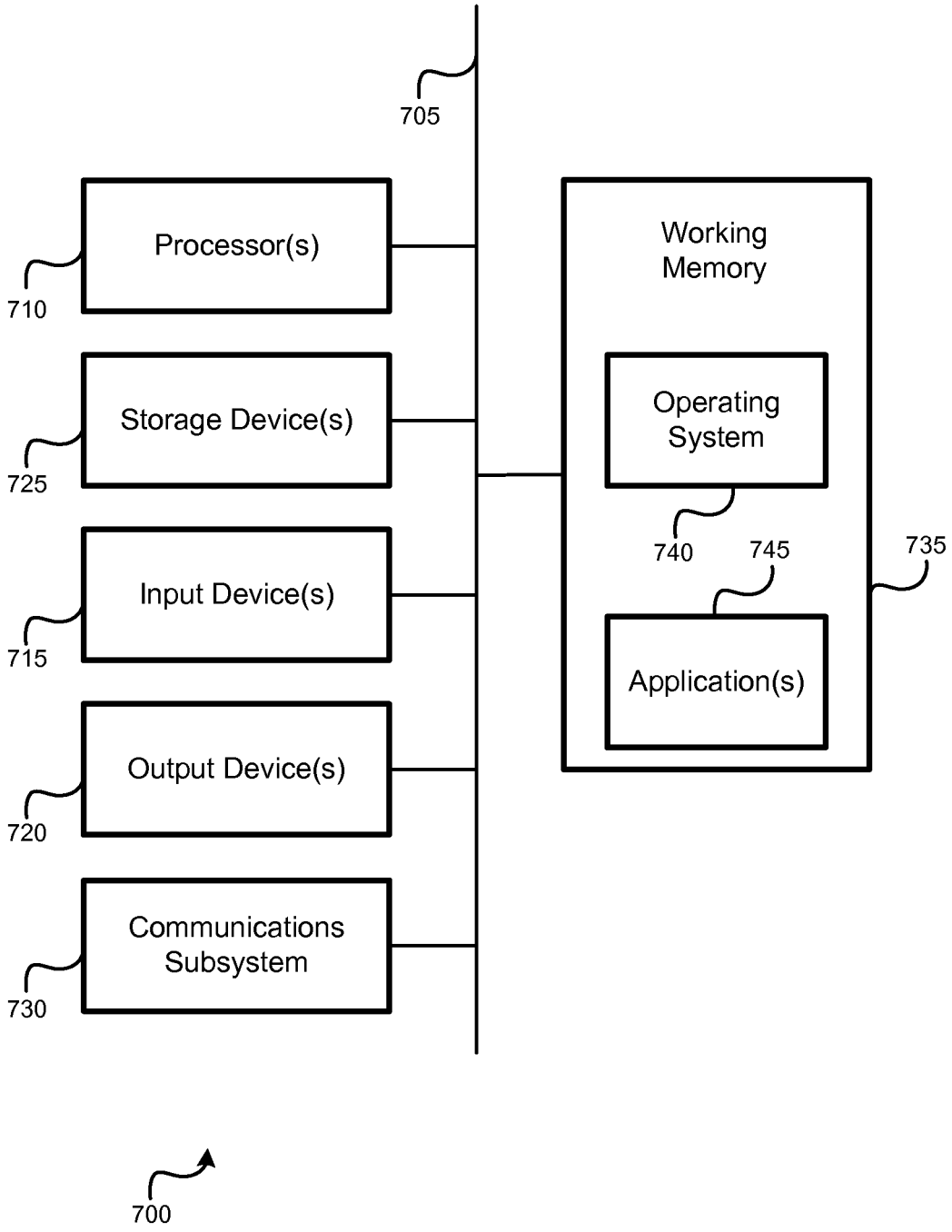
FIG. 7 is a simplified illustration of an embodiment of a computer system that can be utilized to perform one or more of the methods described herein.

FIG. 7 illustrates an embodiment of a computer system 700. A computer system 700 as illustrated in FIG. 7 may be incorporated into devices such as an STB, DVR, television, media system, personal computer, and the like. Moreover, some or all of the components of the computer system 700 may also be incorporated into a portable electronic device, mobile phone, or other image-capturing device as described herein. FIG. 7 provides a schematic illustration of one embodiment of a computer system 700 that can perform the methods provided by various other embodiments. It should be noted that FIG. 7 is meant only to provide a generalized illustration of various components, any or all of which may be utilized as appropriate. FIG. 7, therefore, broadly illustrates how individual system elements may be implemented in a relatively separated or relatively more integrated manner.

The computer system 700 is shown comprising hardware elements that can be electrically coupled via a bus 705 (or may otherwise be in communication, as appropriate). The hardware elements may include one or more processors 710, including without limitation one or more general-purpose processors and/or one or more special-purpose processors (such as digital signal processing chips, graphics acceleration processors, and/or the like); one or more input devices 715, which can include without limitation a mouse, a keyboard, a camera, and/or the like; and one or more output devices 720, which can include without limitation a display device, a printer, and/or the like.

The computer system 700 may further include (and/or be in communication with) one or more non-transitory storage devices 725, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The computer system 700 might also include a communications subsystem 730, which can include without limitation a modem, a network card (wireless or wired), an infrared communication device, a wireless communication device, and/or a chipset (such as a Bluetooth™ device, an 802.11 device, a WiFi device, a WiMax device, cellular communication facilities, etc.), and/or the like. The communications subsystem 730 may include one or more input and/or output communication interfaces to permit data to be exchanged with a network (such as the network described below, to name one example), other computer systems, television, and/or any other devices described herein. Depending on the desired functionality and/or other implementation concerns, a portable electronic device (or similar device) may communicate image and/or other information via the communications subsystem 730. In other embodiments, a portable electronic device (e.g. remote control) may be incorporated into the computer system 700 (e.g., STB) as an input device 715). In many embodiments, the computer system 700 will further comprise a working memory 735, which can include a RAM or ROM device, as described above.

The computer system 700 also can comprise software elements, shown as being currently located within the working memory 735, including an operating system 740, device drivers, executable libraries, and/or other code, such as one or more application programs 745, which may comprise computer programs provided by various embodiments, and/or may be designed to implement methods, and/or configure systems, provided by other embodiments, as described herein. Merely by way of example, one or more procedures described with respect to the method(s) discussed above, such as those described in relation to FIGS. 6A and 6B, might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the storage device(s) 725 described above. In some cases, the storage medium might be incorporated within a computer system, such as computer system 700. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 700 and/or might take the form of source and/or installable code, which, upon compilation and/or installation on the computer system 700 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 700) to perform methods in accordance with various embodiments of the invention. According to a set of embodiments, some or all of the procedures of such methods are performed by the computer system 700 in response to processor 710 executing one or more sequences of one or more instructions (which might be incorporated into the operating system 740 and/or other code, such as an application program 745) contained in the working memory 735. Such instructions may be read into the working memory 735 from another computer-readable medium, such as one or more of the storage device(s) 725. Merely by way of example, execution of the sequences of instructions contained in the working memory 735 might cause the processor(s) 710 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using the computer system 700, various computer-readable media might be involved in providing instructions/code to processor(s) 710 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 725. Volatile media include, without limitation, dynamic memory, such as the working memory 735.

Common forms of physical and/or tangible computer-readable media include, for example, a floppy disk, a flexible disk, hard disk, magnetic tape, or any other magnetic medium, a CD-ROM, any other optical medium, punchcards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 710 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 700.

The communications subsystem 730 (and/or components thereof) generally will receive signals, and the bus 705 then might carry the signals (and/or the data, instructions, etc. carried by the signals) to the working memory 735, from which the processor(s) 710 retrieves and executes the instructions. The instructions received by the working memory 735 may optionally be stored on a non-transitory storage device 725 either before or after execution by the processor(s) 710.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered. Accordingly, the above description does not bound the scope of the claims.

What is claimed is:

1. A method for automatically calibrating content shown on an electronic display, the method comprising:

causing, at an electronic device comprising a television receiver communicatively coupled with the electronic display, a calibration image to be shown on the electronic display, the displayed calibration image having a plurality of calibration elements that each frame at least a portion of the content shown on the electronic display, wherein the calibration elements comprise zones of the calibration image, wherein the calibration image comprises at least three zones extending outward from the center of the electronic display, and wherein interactive elements are displayed only in the center-most zone of the calibration image;

receiving, at the electronic device, via an input interface, a first captured image of the electronic display from a communicatively coupled mobile device, the first captured image including a representation of the displayed calibration image;

comparing, at the electronic device, the representation of the displayed calibration image with a stored calibration image;

determining, at the electronic device, that a position of at least one calibration element of the displayed calibration image is not located at a certain position of the electronic display;

calculating, at the electronic device, using a processor, an amount of adjustment based on the position of the at least one calibration element; and automatically adjusting, at the electronic device, the content shown on the electronic display based, at least in part, on the amount of adjustment.

2. The method for automatically calibrating the content shown on the electronic display of claim 1, wherein receiving the first captured image comprises receiving the first captured image from a portable electronic device via a wireless connection.

3. The method for automatically calibrating the content shown on the electronic display of claim 2, wherein the portable electronic device is a mobile phone with image-capturing functionality.

4. The method for automatically calibrating the content shown on the electronic display of claim 1, wherein adjusting the content shown on the electronic display comprises adjusting a video signal provided to the electronic display.

5. The method for automatically calibrating the content shown on the electronic display of claim 1, further comprising:

receiving a second captured image of the electronic display; and determining whether to make an additional adjustment to the content shown on the electronic display.

6. The method for automatically calibrating the content shown on the electronic display of claim 5 further comprising, after a preset number of adjustment iterations have been performed, automatically initiating a manual process at the electronic device enabling a user to provide input to adjust the content shown on the electronic display.

7. The method for automatically calibrating the content shown on the electronic display of claim 6, wherein the manual process is automatically initiated by the electronic device after the preset number of adjustments has been made.

8. The method for automatically calibrating the content shown on the electronic display of claim 7, wherein the preset number of adjustments is three adjustments.

9. The method for automatically calibrating the content shown on the electronic display of claim 1, wherein the calibration image is an image overlay on the content shown on the electronic display.

10. The method for automatically calibrating content shown on an electronic display of claim 1, wherein the electronic device is a television set-top box.

11. A system for automatically calibrating content shown on an electronic display, the system comprising:

a memory communicatively coupled with and readable by a processing unit and having stored therein processor-readable instructions which, when executed by the processing unit, cause the processing unit to:

output, via an output interface, a calibration image to be shown on the electronic display, the displayed calibration image having a plurality of concentric calibration elements that each frame a portion of the content shown on the electronic display, wherein the calibration elements comprise zones of the calibration image, wherein the calibration image comprises at least three zones extending outward from the center of the electronic display, and wherein interactive elements are displayed only in the center-most zone of the calibration image;

receive, via a communication interface, a first captured image of the electronic display from a physically separate portable electronic device, the first captured image including a representation of the displayed calibration image;

compare the representation of the displayed calibration image with a stored calibration image;

determine that a position of at least one calibration element of the displayed calibration image is not located at a certain position of the electronic display;

calculate an amount of adjustment based on the position of the at least one calibration element; and automatically adjust, via the output interface, the content shown on the electronic display based, at least in part, on the amount of adjustment.

12. The system for automatically calibrating content shown on the electronic display of claim 11, wherein the communication interface is configured to receive the one or more captured images wirelessly.

13. The system for automatically calibrating content shown on the electronic display of claim 11, wherein the system comprises a set-top box configured to be connected to a television via the output interface.

14. The system for automatically calibrating content shown on the electronic display of claim 11, wherein the instructions are configured to cause the processing unit to adjust the content shown on the electronic display by adjusting a video signal provided to the electronic display via the output interface.

15. The system for automatically calibrating content shown on the electronic display of claim 11, wherein the instructions are configured to cause the processing unit to:

receive, via the communication interface, a second captured image of the electronic display; and determine whether to make an additional adjustment to the content shown on the electronic display.

16. The system for automatically calibrating content shown on the electronic display of claim 11 further comprising a user interface, wherein the instructions are configured to cause the processing unit to, after a preset number of adjustment have been performed, receive manual input to adjust the content shown on the electronic display via the user interface.

17. The system for automatically calibrating content shown on the electronic display of claim 11, wherein the instructions are configured to cause the processing unit to show the calibration image is an image overlay on the content shown on the electronic display.

* * * * *